US009623938B2

(12) United States Patent
McNealey, IV

(10) Patent No.: US 9,623,938 B2
(45) Date of Patent: Apr. 18, 2017

(54) FLOATATION SUPPORT DEVICE

(71) Applicant: John McNealey, IV, Cape Coral, FL (US)

(72) Inventor: John McNealey, IV, Cape Coral, FL (US)

( * ) Notice: Subject to any disclaimer, the term of this patent is extended or adjusted under 35 U.S.C. 154(b) by 71 days.

(21) Appl. No.: 14/693,072

(22) Filed: Apr. 22, 2015

(65) Prior Publication Data

US 2016/0311508 A1 Oct. 27, 2016

(51) Int. Cl.

| | |
|---|---|
| ***B63B 35/76*** | (2006.01) |
| ***A47C 15/00*** | (2006.01) |
| ***B63B 35/74*** | (2006.01) |

(52) U.S. Cl.

CPC ..... *B63B 35/76* (2013.01); *A47C 15/006* (2013.01); *B63B 35/74* (2013.01)

(58) Field of Classification Search

CPC ..... A63B 31/00; A47C 15/006; B63B 35/74; B63B 35/76; B63B 35/78; B63C 9/02; B63C 9/08; B63C 9/081; B63C 9/082; B63C 2009/084; B63C 2009/085; B63C 9/28; B63C 9/30

USPC ..... 441/129–132

See application file for complete search history.

(56) References Cited

U.S. PATENT DOCUMENTS

| | | | | |
|---|---|---|---|---|
| 2,717,400 | A | 9/1955 | Bourdon | |
| 4,358,866 | A * | 11/1982 | Rhodes | A47C 15/006 114/363 |
| 4,861,300 | A * | 8/1989 | Casagrande | B63B 35/76 441/131 |
| 5,772,484 | A * | 6/1998 | Sikorski | B63B 35/73 441/131 |
| 6,132,276 | A | 10/2000 | Leemon | |
| 6,843,695 | B1 * | 1/2005 | Jackson | A61H 3/008 441/129 |
| 7,955,226 | B2 * | 6/2011 | Dauben | A63B 31/00 441/129 |
| 8,628,366 | B2 * | 1/2014 | Pope | B63B 35/73 441/129 |
| 9,051,032 | B2 * | 6/2015 | Hanel | B63B 35/74 |
| 2002/0009934 | A1 | 1/2002 | Watler | |

* cited by examiner

*Primary Examiner* — Ajay Vasudeva

(57) ABSTRACT

A floatation support device supports a person in a seated or prone position in a body of water. The device includes a pair of frames each having an elbow coupling a first section to a second section. The elbow of each frame forms a right angle between the first section and the second section. A first tube is flexible and buoyant in water. The first section of each of the frames is inserted into an associated end of the first tube wherein the first tube couples the first sections together. A second tube is flexible and buoyant in water. The second section of each of the frames is inserted into an associated end of the second tube wherein the second tube couples the second sections together.

8 Claims, 3 Drawing Sheets

FLOATATION SUPPORT DEVICE

BACKGROUND OF THE DISCLOSURE

Field of the Disclosure

The disclosure relates to support devices and more particularly pertains to a new support device for supporting a person in a variety of positions while in a body of water.

SUMMARY OF THE DISCLOSURE

An embodiment of the disclosure meets the needs presented above by generally comprising a pair of frames each having an elbow coupling a first section to a second section. The elbow of each frame forms a right angle between the first section and the second section. A first tube is flexible and buoyant in water. The first section of each of the frames is inserted into an associated end of the first tube wherein the first tube couples the first sections together. A second tube is flexible and buoyant in water. The second section of each of the frames is inserted into an associated end of the second tube wherein the second tube couples the second sections together.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
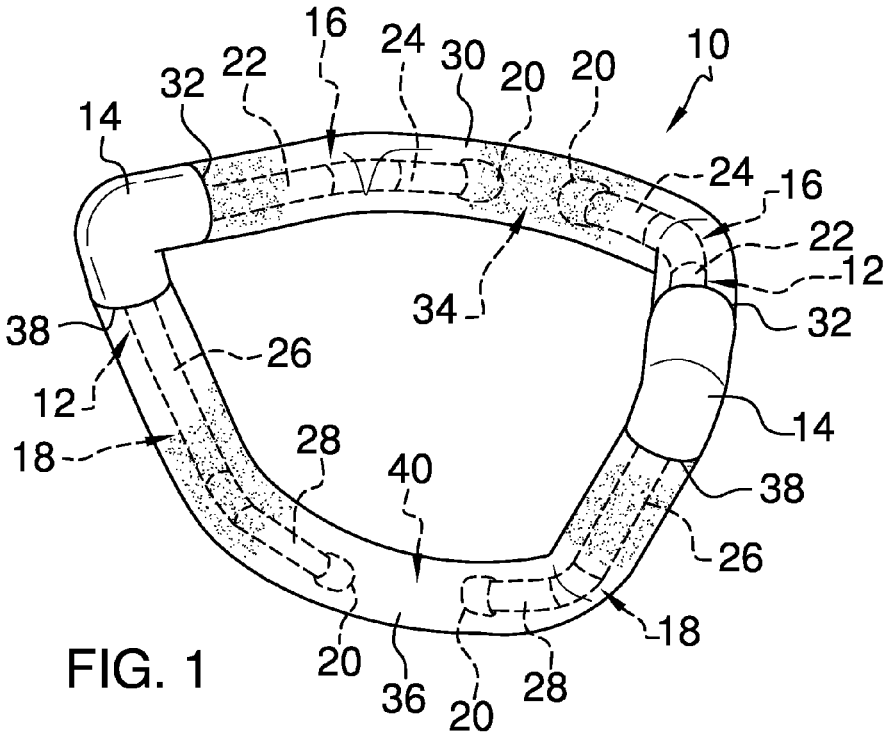
FIG. 1 is a bottom front side perspective view of a floatation support device according to an embodiment of the disclosure.
Figure 2:
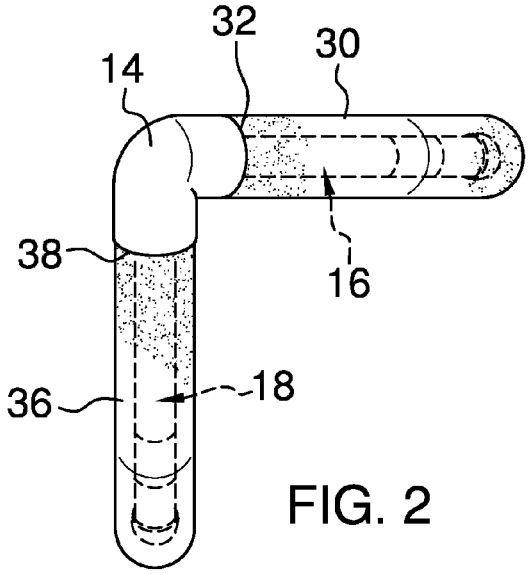
FIG. 2 is a side view of an embodiment of the disclosure.
Figure 3:
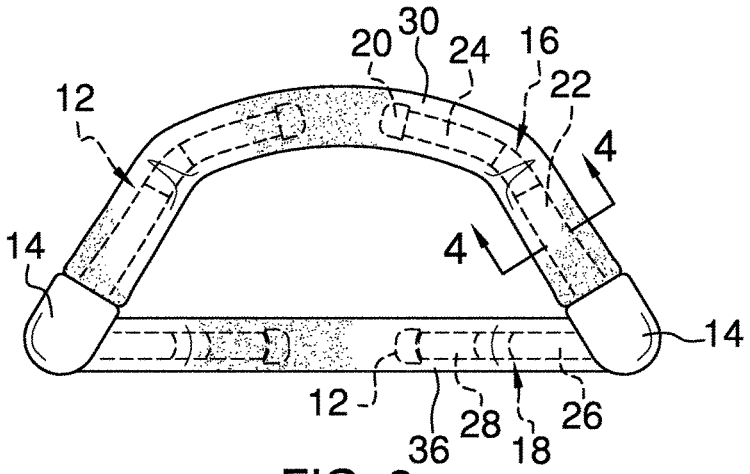
FIG. 3 is a front view of an embodiment of the disclosure.
Figure 4:
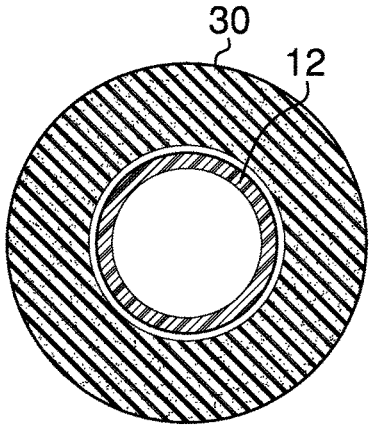
FIG. 4 is a cross-sectional view of an embodiment of the disclosure taken along line 4-4 of FIG. 3.

With reference now to the drawings, and in particular to FIGS. 1 through 6 thereof, a new support device embodying the principles and concepts of an embodiment of the disclosure and generally designated by the reference numeral 10 will be described.

As best illustrated in FIGS. 1 through 6, the floatation support device 10 generally comprises a pair of frames 12. Each frame 12 is hollow being comprised of polyvinylchloride tubing or the like. Each frame 12 has a respective elbow 14 coupling a first section 16 to a second section 18. The elbow 14 of each frame 12 forms a right angle between the first section 16 and the second section 18. Opposite ends 20 of each frame 12 are closed by an end cap or the like. The first section 16 of each of the frames 12 comprises a first portion 22 and a second portion 24. Each of the first portion 22 and the second portion 24 is substantially straight and coplanar. The second portion 24 defines an angle with the first portion 22 between 35 and 55 degrees. Similarly, the second section 18 of each of the frames 12 comprises a proximal portion 26 and a distal portion 28 relative to the elbow 14. Each of the proximal portion 26 and the distal portion 28 is substantially straight and coplanar. The distal portion 28 defines an angle with the proximal portion 26 between 35 and 55 degrees.

A first tube 30 has opposite ends 32. The first tube 30 is flexible and buoyant in water being constructed of a conventional foam material or the like. The first section 16 of each of the frames 12 is inserted into an associated one of the opposite ends 32 of the first tube 30 wherein the first tube 30 couples the first sections 16 together. Each of the associated ends 32 of the first tube 30 abuts an associated one of the elbows 14 wherein the first tube 30 fully covers the first sections 16 of the frames 12. The first tube 30 has a length greater than a combined length of the first sections 16 of the frames 12 such that a gap 34 is defined between the first sections 16 within the first tube 30.

A second tube 36 has opposite ends 38. The second tube 36 is flexible and buoyant in water being constructed of the same material as the first tube 30. The second section 18 of each of the frames 12 is inserted into an associated one of the opposite ends 38 of the second tube 36 wherein the second tube 36 couples the second sections 18 together. Each of the associated ends 38 of the second tube 36 abuts an associated one of the elbows 14 wherein the second tube 36 fully covers the second section 18 of the frames 12. The second tube 36 has a length greater than a combined length of the second sections 18 of the frames 12 such that a space 40 is defined between the second sections 18 within the second tube 36.

Figure 5:
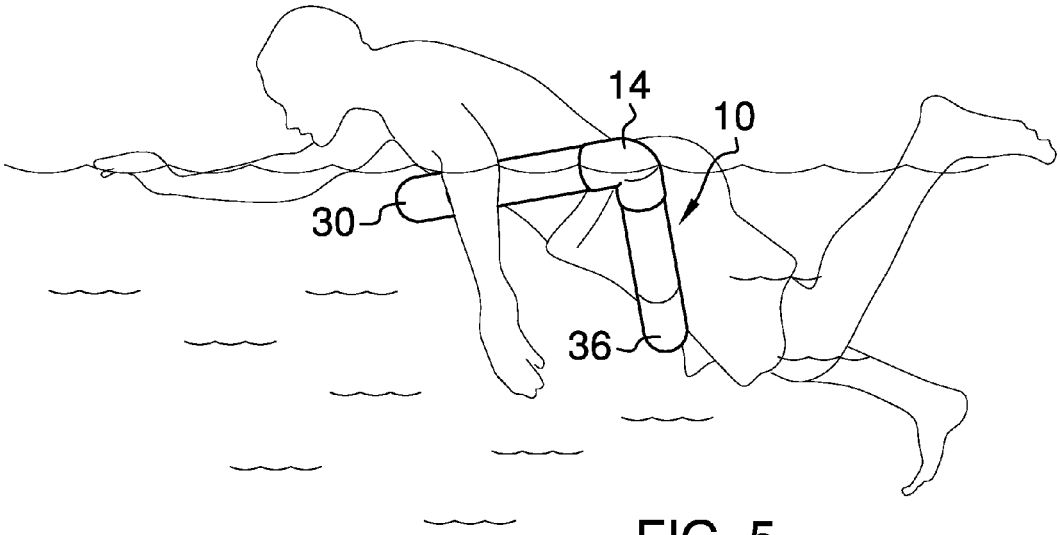
FIG. 5 is a side view of an embodiment of the disclosure in use.
Figure 6:
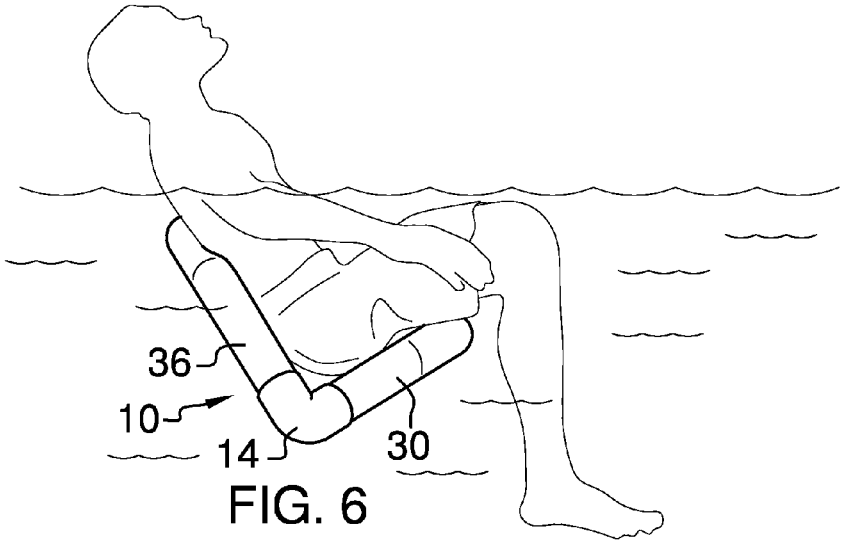
FIG. 6 is a side view of an embodiment of the disclosure in use.

In use, the first tube 30 and the second tube 36 are coupled to the frames 12 as described above. The frames 12 then support the first tube 30 and second tube 36 in the desired shape to allow the device 10 to be used in a body of water to support a person in a seated position, as in FIG. 6, or in a prone position, as shown in FIG. 5.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A floatation support device comprising:

a pair of frames, each said frame having an elbow coupling a first section to a second section, said elbow of each said frame forming a right angle between said first section and said second section;

a first tube having opposite ends, said first tube being flexible and buoyant in water, said first section of each of said frames being inserted into an associated one of said opposite ends of said first tube wherein said first tube couples said first sections together;

a second tube having opposite ends, said second tube being flexible and buoyant in water, said second section of each of said frames being inserted into an associated one of said opposite ends of said second tube wherein said second tube couples said second sections together; and each of said first sections comprising a first portion and a second portion, each of said first portion and said second portion being straight, said second portion defining an angle with said first portion between 35 and 55 degrees.

2. The device of claim 1, further comprising each of said associated ends of said first tube abutting an associated one of said elbows wherein said first tube fully covers said first sections of said frames.

3. The device of claim 1, further comprising said second section of each of said frames comprising a proximal portion and a distal portion relative to said elbow, each of said proximal portion and said distal portion being straight, said distal portion defining an angle with said proximal portion between 35 and 55 degrees.

4. The device of claim 1, further comprising:

each said frame being hollow; and opposite ends of each said frame being closed.

5. The device of claim 1, further comprising:

each said frame being hollow, opposite ends of each said frame being closed, said second section of each of said frames comprising a proximal portion and a distal portion relative to said elbow, each of said proximal portion and said distal portion being straight, said distal portion defining an angle with said proximal portion between 35 and 55 degrees;

each of said associated ends of said first tube abutting an associated one of said elbows wherein said first tube fully covers said first sections of said frames, said first tube having a length greater than a combined length of said first sections of said frames such that a gap is defined between said first sections within said first tube; and each of said associated ends of said second tube abutting an associated one of said elbows wherein said second tube fully covers said second section of said frames, said second tube having a length greater than a combined length of said second sections of said frames such that a space is defined between said second sections within said second tube.

6. A floatation support device comprising:

a pair of frames, each said frame having an elbow coupling a first section to a second section, said elbow of each said frame forming a right angle between said first section and said second section;

a first tube having opposite ends, said first tube being flexible and buoyant in water, said first section of each of said frames being inserted into an associated one of said opposite ends of said first tube wherein said first tube couples said first sections together;

a second tube having opposite ends, said second tube being flexible and buoyant in water, said second section of each of said frames being inserted into an associated one of said opposite ends of said second tube wherein said second tube couples said second sections together;

each of said associated ends of said first tube abutting an associated one of said elbows wherein said first tube fully covers said first sections of said frames; and each of said associated ends of said second tube abutting an associated one of said elbows wherein said second tube fully covers said second section of said frames.

7. The device of claim 6, further comprising said second tube having a length greater than a combined length of said second sections of said frames such that a space is defined between said second sections within said second tube.

8. A floatation support device comprising:

a pair of frames, each said frame having an elbow coupling a first section to a second section, said elbow of each said frame forming a right angle between said first section and said second section;

a first tube having opposite ends, said first tube being flexible and buoyant in water, said first section of each of said frames being inserted into an associated one of said opposite ends of said first tube wherein said first tube couples said first sections together;

a second tube having opposite ends, said second tube being flexible and buoyant in water, said second section of each of said frames being inserted into an associated one of said opposite ends of said second tube wherein said second tube couples said second sections together;

each of said associated ends of said first tube abutting an associated one of said elbows wherein said first tube fully covers said first sections of said frames; and said first tube having a length greater than a combined length of said first sections of said frames such that a gap is defined between said first sections within said first tube.

* * * * *